US007243887B2

(12) United States Patent
Magnusson

(10) Patent No.: US 7,243,887 B2
(45) Date of Patent: Jul. 17, 2007

(54) SUSPENSION SYSTEM

(75) Inventor: Reine Magnusson, Västervik (SE)

(73) Assignee: Elfa International AB, Västervik (SE)

( * ) Notice: Subject to any disclaimer, the term of this patent is extended or adjusted under 35 U.S.C. 154(b) by 204 days.

(21) Appl. No.: 10/909,394

(22) Filed: Aug. 3, 2004

(65) Prior Publication Data

US 2005/0045787 A1 Mar. 3, 2005

Related U.S. Application Data

(60) Provisional application No. 60/495,703, filed on Aug. 18, 2003.

(30) Foreign Application Priority Data

Aug. 18, 2003 (SE) ..... 0302229

(51) Int. Cl.

| | |
|---|---|
| ***F24H 9/06*** | (2006.01) |
| ***A47G 29/02*** | (2006.01) |
| ***E04G 3/08*** | (2006.01) |
| ***E06B 7/28*** | (2006.01) |

(52) U.S. Cl. ..... 248/243; 248/235; 248/241

(58) Field of Classification Search ..... 248/235, 248/239, 241, 243, 245, 246, 247

See application file for complete search history.

(56) References Cited

U.S. PATENT DOCUMENTS

| | | | | |
|---|---|---|---|---|
| 2,428,073 | A * | 9/1947 | Handel | 211/119.004 |
| 3,172,540 | A * | 3/1965 | Berge | 211/106.01 |
| 5,868,263 | A * | 2/1999 | McAllister et al. | 211/90.01 |
| 6,202,966 | B1 | 3/2001 | MacDonald et al. | |
| 6,227,506 | B1 * | 5/2001 | Benedict | 248/249 |

FOREIGN PATENT DOCUMENTS

| | | |
|---|---|---|
| GB | 1270569 | 4/1972 |
| SE | 142302 | 7/1953 |

* cited by examiner

*Primary Examiner*—Amy J. Sterling
(74) *Attorney, Agent, or Firm*—Buchanan Ingersoll & Rooney PC

(57) ABSTRACT

A system for detachable suspension of shelves (4) from essentially vertically positioned carrier elements (1, 26) provided with slots or grooves (2). Elongate, U-shaped supporting elements (3, 25) are adapted to support said shelves (4) and are fixed in a protruding manner to the carrier elements (1). The system further comprises fasteners (7), which are adapted to be arranged on the underside (8) of the shelf (4), adjacent two opposite side edges (9) of the shelf (4), and which are adapted to engage the uppermost portion (23) of the respective supporting elements (3, 25). Each fastener (7) comprises a first portion (13), which is adapted to be attached at right angles to the underside (8) of the shelf (4), a second portion (14), which is perpendicular to the first portion (13) and intended to abut against the underside (8) of the shelf (4), and a third portion (15), which is essentially parallel to said first portion (13) and intended to be inserted into the interior of the U-shaped supporting element (3, 25). The fastener (7) is adapted to be arranged in two opposite positions on the underside (8) of the shelf (4), ie a first position in which the second portion (14) of the fastener (7) is oriented towards the side edge (9) of the shelf (4, 4'), thus allowing two shelves (4) to be arranged with their side edges (9) next to one another and to be supported by the same supporting element (3, 25), and a second position in which the second portion (4) of the fastener (7) is oriented away from the side edge (9) of the shelf, the side edge (9) of the shelf (4) protruding from the supporting element (3, 25).

20 Claims, 5 Drawing Sheets

SUSPENSION SYSTEM

This Application claims priority under 35. U.S.C. § 119 to Swedish Application No. 0302229-0, filed Aug. 18, 2003, and to U.S. Provisional Application No. 60/495,703, filed Aug. 18, 2003.

The present invention relates to a system for detachable suspension of shelves from a wall or as a freestanding arrangement, comprising at least two essentially vertically positioned carrier elements and elongate, U-shaped supporting elements, which are adapted to support said shelves and which are fixed in a protruding manner to the carrier elements, and fasteners, which are adapted to be arranged on the underside of the shelf, adjacent two opposite side edges of the shelf, and which are adapted to engage the uppermost portion of the respective supporting elements, each fastener comprising a first portion, which is adapted to be attached at right angles to the underside of the shelf, and a second portion, which is perpendicular to the first portion and intended to abut against the underside of the shelf.

Systems for suspension of shelves from vertical carrier elements by means of two brackets, which can be releasably attached at any desired level to the carrier elements, are previously known, for example, from the Elfa International AB catalogue "Planerings-och produktguide". The shelves are made of a wood material and are intended to be screwed to the brackets. In addition to the inconvenient screwing operation, specially designed brackets thus have to be used for the shelves. It also means that a bracket, which usually is a sheet-metal panel that has been bent to a U-shape, can support only one shelf end and not the end of an adjacent shelf.

A specially designed bracket that can support two adjacent shelf ends is previously known from U.S. Pat. No. 6,202,966. In this construction, too, the shelf ends are intended to be screwed to the bracket.

In the former case, a bracket can support only one shelf end, the side edge of which will then protrude from the bracket. In the latter case, the side edges of the shelf ends do not protrude from the bracket. In addition to the trouble associated with mounting the shelves on the brackets and dismounting them, the user is not free to decide whether to end a set of shelves at a selected bracket (with a projecting shelf end) or extend the set by adding one more shelf.

Swedish patent application No. 142 302 discloses a way of positioning a shelf joint on a U-shaped bracket. An extension bar is arranged by means of screws on the ends of the two shelves. The extension bar, whose length essentially corresponds to the width of the shelves, has a longitudinal boss or bulge, which is intended to be inserted in a U-shaped bracket that is open at the top. The boss prevents the horizontal displacement of the shelf by engaging the inside of the bracket legs. This construction, too, requires screws and only allows two shelves to be joined together but not one shelf to make up the end with its side edge protruding from the bracket.

An object of the invention is to provide a suspension system that allows easy mounting of a shelf on a supporting element and easy dismounting from said element.

A further object of the invention is to provide a suspension system that allows the user to decide whether to join two shelves together adjacent a supporting element or to let a shelf end adjacent the supporting element with a protruding side edge.

Another object of the invention is to provide a suspension system which comprises slightly modified standard brackets or crossbars.

Yet another object of the invention is to provide a suspension system which comprises simple and inexpensive fasteners.

According to the invention, these objects are achieved by a suspension system as described by way of introduction, which is characterised in that the fastener also comprises a third portion, which is essentially parallel to said first portion and intended to be inserted into the interior of the U-shaped supporting device, and that the fastener is adapted to be arranged in two opposite positions on the underside of the shelf, ie a first position in which the second portion of the fastener is oriented towards said side edge of the shelf, thus allowing two shelves to be arranged with their side edges next to one another and to be supported by the same supporting element, and a second position in which the second portion of the fastener is oriented away from the side edge of the shelf, the side edge of the shelf protruding from the supporting element when the shelf is arranged thereon.

Further developments of the invention are defined by the features stated in the sub claims.

Preferred embodiments of the invention will be described below by way of example and with reference to the accompanying drawings, in which FIG. 1 is an exploded perspective view from above of the elements included in the inventive suspension system for suspending a shelf from a carrier element;

Figure 1:
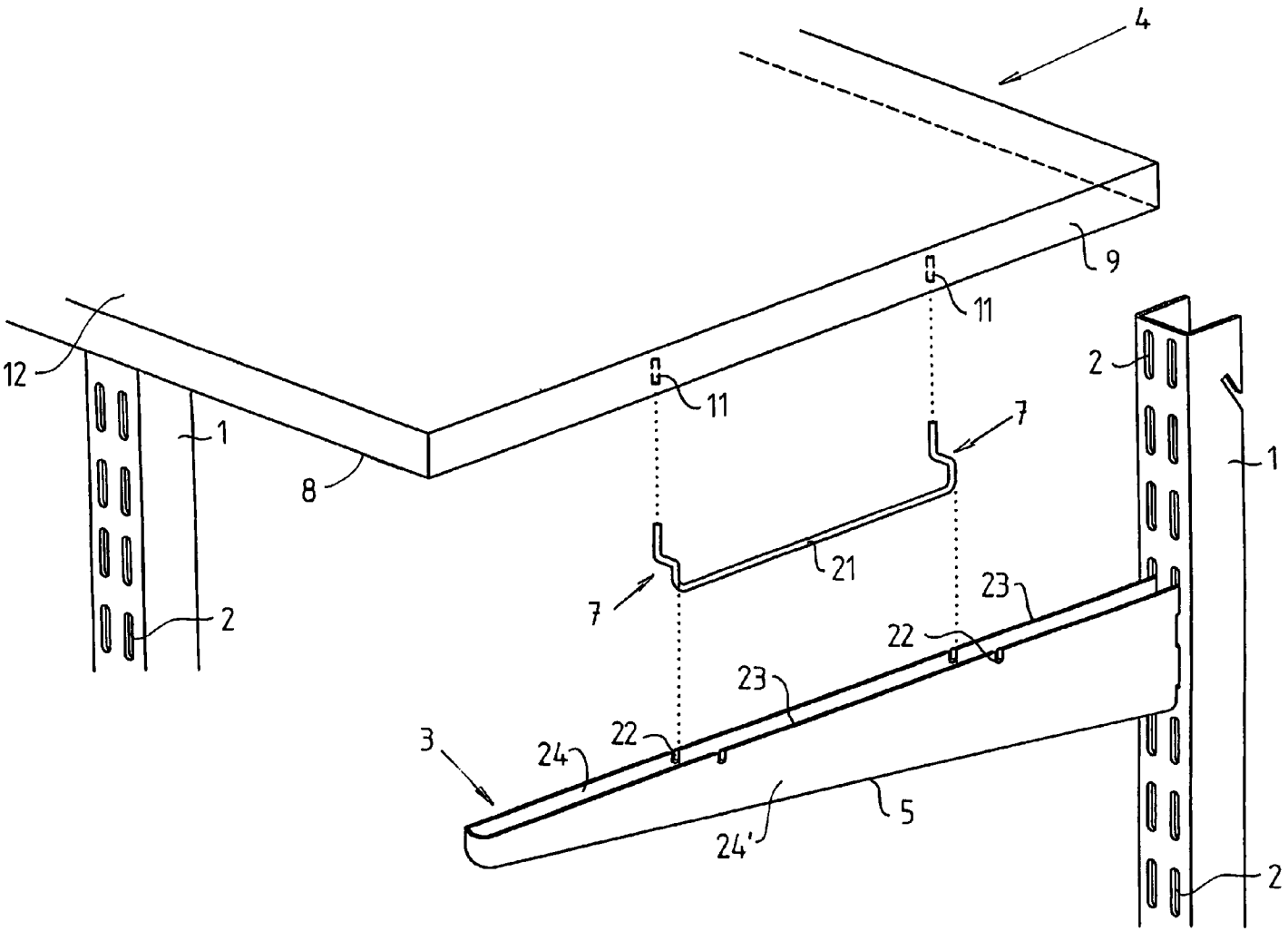
Figure 2:
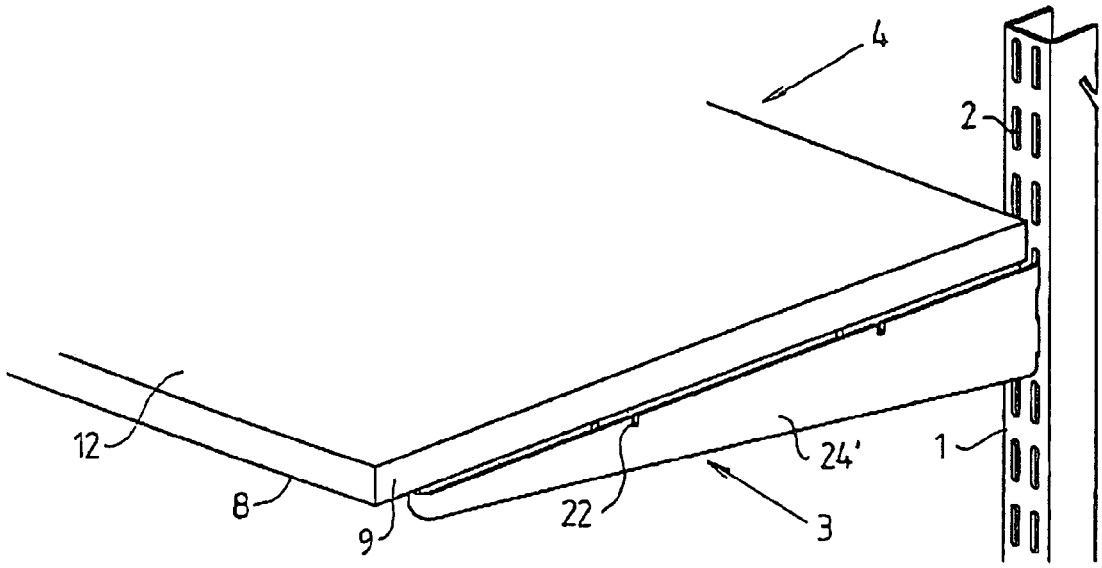
FIG. 2 is a perspective view corresponding to that in FIG. 1, and to a reduced scale, of a shelf mounted on a bracket and adapted to be joined together with an additional shelf (not shown)

With reference first to FIG. 1, which is a perspective view from above of an inventive suspension system, the system comprises per se known, essentially vertically positioned carrier elements 1. The carrier element may be freestanding and supported by a pair of feet resting on a substructure, such as a floor (not shown). It is preferred, however, for the carrier element to be a bar or a section that is attached to or integrated in a wall. Preferably, the carrier element 1 has the form of a U-shaped bar that is screwed to the wall or a hang bar suspended from a carrier rail attached to the wall, as shown in the Elfa catalogue "Planerings-och produktguide".

The carrier element or rail 1 is provided with two parallel rows of slots or grooves 2 of the same dimension and evenly spaced-apart in the longitudinal direction.

The suspension system illustrated also includes a number of brackets 3, which are adapted to be used in pairs to detachably support a shelf 4. Only one of the brackets 3 is shown in FIG. 1, but it will be readily appreciated that each one bracket is suspended from the associated carrier element 1 for each shelf.

Figure 4:
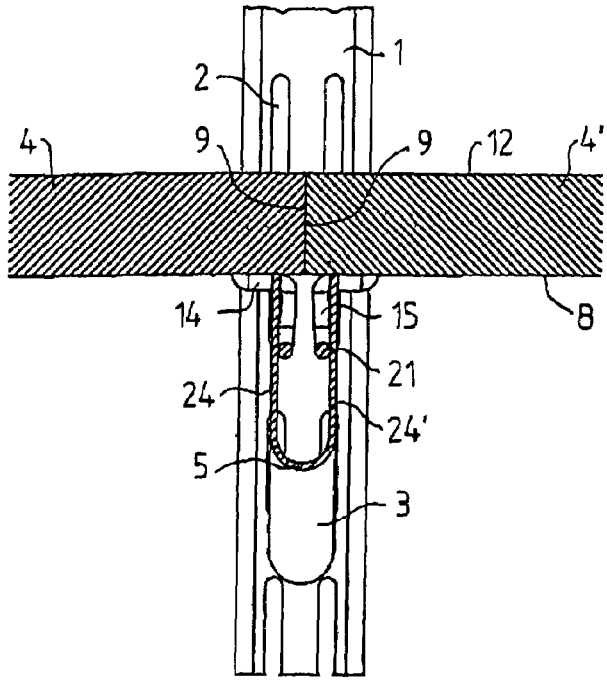
FIG. 4 is a sectional view through and perpendicularly to the bracket illustrating the suspension system when used to join two shelves according to FIG. 2.
Figure 5:
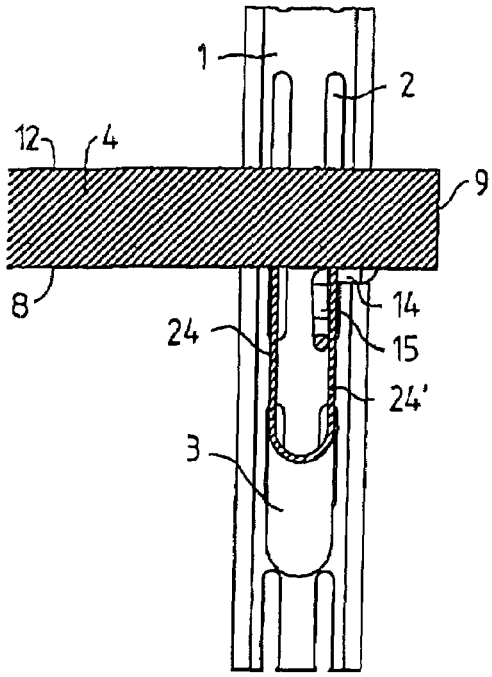
FIG. 5 is a view similar to FIG. 3 of the suspension system when used to mount a single shelf making up the end as shown in FIG. 3.

Preferably, the bracket 3 is made from a sheet-metal panel that has been bent to a U-shape. The bend 5 is located in the lower part of the bracket (as seen when mounted) and the free ends are located in the upper part as shown in FIGS. 4 and 5.

Figure 10:
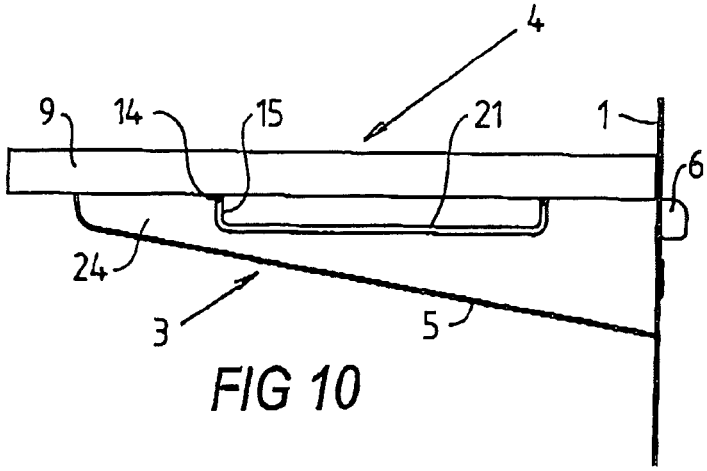
FIG. 10 is a longitudinal section through the bracket and illustrates a shelf mounted on a bracket and adapted to be joined together with an additional shelf according to FIG. 2.

Moreover, the bracket 3 has a pair of hook-shaped, projecting portions 6 at one end, which are intended to be inserted in a pair of selected slots 2 in the carrier element or the rail 1 and to engage an area inside the carrier element 1 adjacent to the slot 2 for suspending the bracket from the carrier element, as depicted in FIG. 10.

Figure 6:
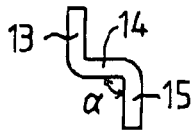
FIG. 6 is a side view of a separate fastener.

To releasably attach a shelf 4 to a pair of brackets 3, the inventive suspension system further comprises fasteners 7, see in particular FIG. 6. The fasteners 7 are adapted to be attached to the underside 8 of the shelf 4 and adjacent two opposite side edges 9 of the shelf. One or more holes 11 have been drilled in the shelf, which extend from the underside 8 of the shelf to the side edge 9 and towards, but not up to, the upper side 12 of the shelf. Preferably, the fasteners 7 are adapted to be inserted in the respective holes, but in an alternative embodiment they are attached using a screw provided for that purpose, which is screwed into each 1 hole 11, as will be described in more detail with reference to FIG. 7.

Referring now to FIG. 6, each fastener 7 comprises a first portion 13, which is adapted to be fixed in the associated hole 11, perpendicularly to the underside 8 of the shelf, by inserting or screwing it into said hole 11. The fastener further comprises a second portion 14, which is perpendicular to the first portion 13 and intended to abut, when mounted, against the underside 8 of the shelf. Moreover, each fastener comprises a third portion 15, which is essentially parallel to the first portion 13, and which, during mounting, is intended to be inserted into the U-shaped bracket 3, as will be described in more detail below. With reference to FIG. 6, it is also shown that each fastener is advantageously made in one piece from a bent wire or metal rod of any optional cross-section. Alternatively, the fastener can be made of injection-moulded plastic.

Figure 7:
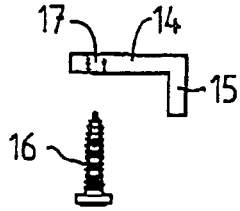
FIG. 7 is a side view of an alternative embodiment of a separate fastener.

FIG. 7 illustrates a modified embodiment of the fastener. This fastener differs from the fastener shown in FIG. 6 in that the first portion 13 of the fastener is not made in one piece with the second portion 14 of the fastener, but consists of a screw 16 that is received in a through hole 17 in the second portion. In this embodiment, the second portion 14 preferably has a rectangular cross-section, while the third portion 15 of the fastener can be essentially cylindrical. When mounting a shelf, the screw 16 is adapted to be screwed into said (predrilled) hole 11 in the lower portion of the shelf.

Figure 9:
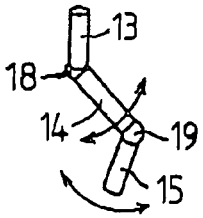
FIG. 9 illustrates schematically a fastener provided with joints.

A conceivable variant of the fastener is illustrated schematically in FIG. 9. According to this variant, the first 13, second 14 and third 15 portions of the fastener are connected to each other in a pivoting manner or by means of joints 18, 19, as indicated by the two-way arrows in FIG. 9.

In the embodiments of the inventive fastener illustrated in FIGS. 6, 7 and 9, the fasteners 7 are depicted as separate or individual units. However, the fasteners intended to be arranged on the shelf 4 at the same side edge 9 thereof can advantageously be connected to each other. Thus, FIG. 1 shows two fasteners 7 according to FIG. 6 which are connected to each other by means of an intermediate element 21. Preferably, said fasteners 7 and the intermediate element 21 are made in one piece and, in this case, from a single bent wire or rod, or alternatively an injection-moulded piece, as described in connection with FIG. 6.

Figure 8:
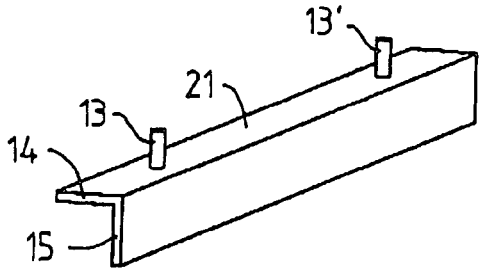
FIG. 8 is a perspective view of an embodiment with integrated fasteners.

An alternative embodiment of the fasteners 7 and the intermediate element 21 connecting them to one another is shown in FIG. 8. According to this embodiment, the second 14 and third 15 portion of each fastener are plate-shaped (cf. FIG. 7, second portion 14) and extend from the first portion 13 of one fastener to the first portion 13' of the other fastener and thus forms an L-shaped section or plate. The first portion, the second and third portion, respectively, are made of any chosen material, but the first portions 13, 13' are preferably essentially cylindrical and can comprise external, annular bosses or projections (not shown) for secure engagement with said hole 11.

Figure 3:
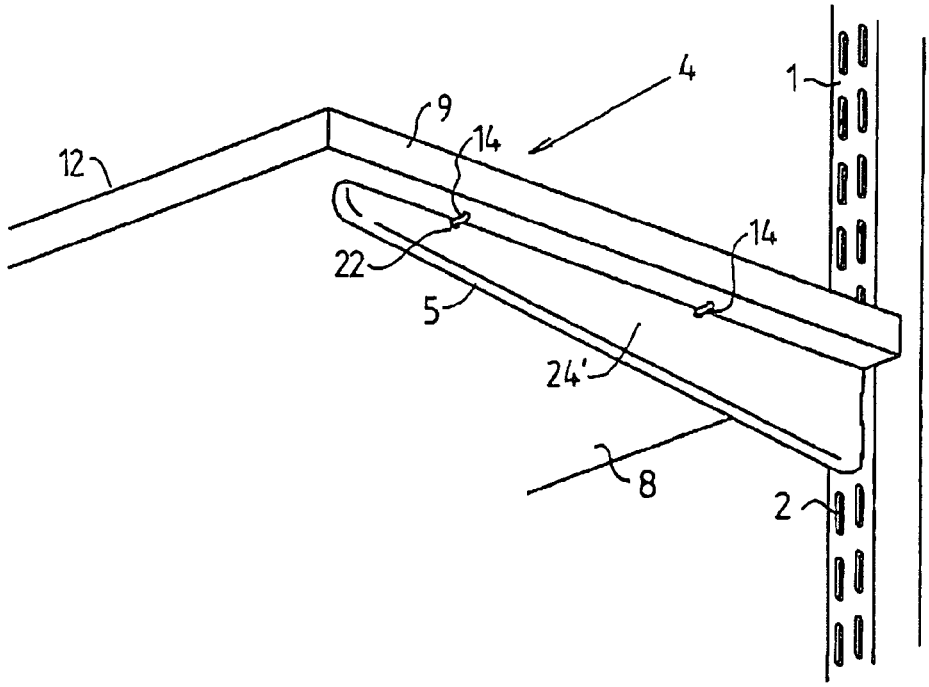
FIG. 3 is a perspective view from below, and in the same scale as in FIG. 2, of a shelf mounted on a bracket to make up the end with its side edge protruding from the bracket.

The design allows the fasteners 7 to be arranged in two opposite positions on the underside 8 of the shelf 4, ie a first position in which the second portion 14 of the fastener is oriented from its first portion 13 towards the closest the side edge 9 of the shelf, as shown in FIGS. 1, 2, 4 and 10. In the second, opposite position, the second portion 14 of the fastener is thus oriented from its first portion 13 away from and substantially perpendicularly to said side edge 9, as shown in FIGS. 3 and 5. When each fastener 7 is designed as a separate unit, ie as illustrated in FIGS. 6, 7 and 9, the are pivoted about the first portion 13 or 16, alternatively, with said portion inserted in the hole 11. When the fasteners are connected to one another, as illustrated in, FIGS. 1 and 8, they naturally have to be removed from the holes 11 and reinserted in the opposite position. This is also true for fasteners designed as a separate unit if their first portion has a cross-sectional shape other than circular, for example oval or polygon, for the purpose of facilitating the positioning of their second portion at right angles to the side edge 9 and maintaining it in that position.

When mounting the shelf 4 on the bracket 3 the first portion 13 of the fasteners 7 are inserted in the associated holes 11 in the shelf, as described above. The second portion 14 of the fasteners are then positioned in recesses 22 provided in the uppermost portion of the bracket, ie at the end of its legs 24 that is located opposite said bend 5. The shape and dimensions of the recesses 22 correspond to the cross-sectional shape and dimensions of said second portions 14, so that the underside 8 of the shelf will rest on the uppermost portion 23 of the bracket (cf. FIGS. 4 and 5). The third portion 15 of the fasteners have then been positioned inside the bracket and abut against the inside of one of its legs 24, 24'. The shelf 4 is thereby fixed with respect to horizontal displacements. Preferably, the angle ac between the second 14 and third 15 portions is slightly smaller than 90°, which allows the third portions to be caused to engage said legs 24, 24' in a clamping manner (see FIGS. 4, 5 and 6). Advantageously, the angle $\alpha$ is in the range 84°-89°, and most preferred 87°.

As stated above, the fasteners 7 can be arranged in two opposite positions on the underside of the shelf. The length of the second portion 14 of the fasteners relative to the distance of the holes 11 from the side edge 9 of the shelf is such that, when mounting the shelf 4 on the bracket 3, the side edge will be located essentially in the centre of the bracket, ie at the symmetry plane of the bracket, when the fasteners 7 have been arranged in said first position (with the second portion of the fastener oriented towards the side edge 9). This is best shown in FIG. 4, which also shows that a second shelf 4' on which the fasteners are positioned correspondingly can be arranged on the same bracket, one side edge next to the other side edge and pressing against one another, the third portion 14 of the fasteners being thereby caused to engage the respective legs 24, 24' in a clamping manner.

In the second, opposite position, ie with the second portion 14 of the fastener oriented away from the side edge 9, the shelf 4 will rest on both legs 24, 24' of the bracket, its side edge 9 protruding from the bracket, as is best shown in FIG. 5.

The side edge (not shown) of the shelf located opposite said side edge 9 is fixed in an adjacent carrier element (not shown), the fasteners 7 being caused to engage, when mounting the shelf, the second leg 24' of the bracket in a clamping manner. In said first position, the third portion 15 of the fasteners engages the first leg 24 of the bracket, as has been shown. The side edge of the shelf not shown is fixed by the fasteners being located in the first position (joining of shelves) or in the second position (suspension of a single shelf).

Figure 11:
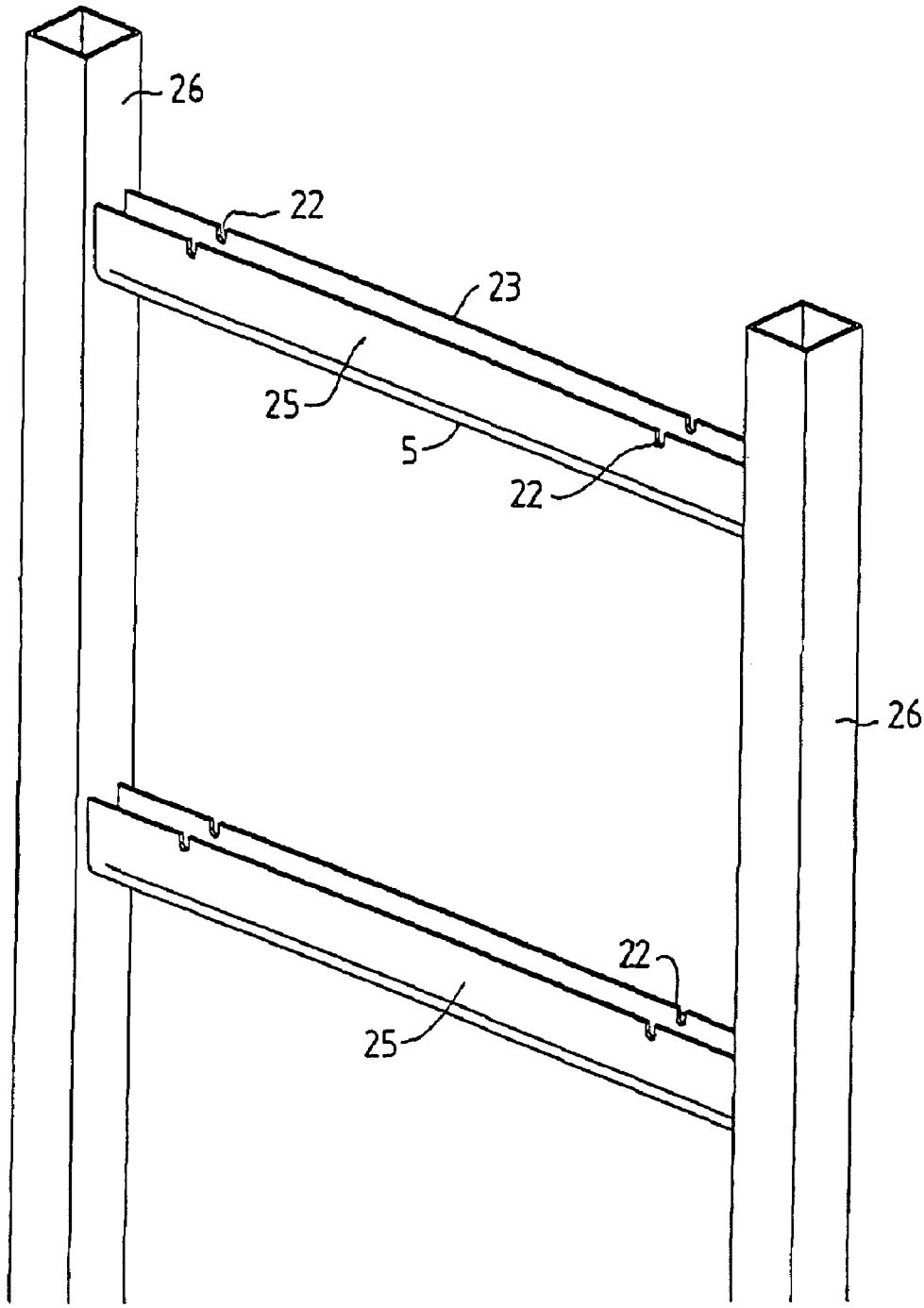
FIG. 11 is a perspective view of a variant of the inventive suspension system.

According to FIGS. 1-5 and 10, the suspension system according to the invention comprises U-shaped carrier elements 1 having slots 2 for detachable suspension of brackets 3 at any chosen height. The invention is not limited to that described above, but other variants of the carrier elements and supports are, of course, conceivable. FIG. 11 shows one example of such a variant.

FIG. 11 illustrates an end part forming part of a freestanding storage rack, which end part comprises a pair of posts or uprights 26, which serve as said carrier elements. The posts 26 are connected to one another by means of two or more horizontal crossbars or transverse girders 25. The crossbars 25 are fixedly attached to the post 26, but can also be releasably attached to said posts by the posts being provided with slots corresponding to the slots 2 in the carrier element 1 (not shown), in which case the crossbars have corresponding, protruding portions similar to the protruding portions 6 of the brackets 3 (cf. FIG. 10).

Like the brackets 3, the crossbars 25 are made from a sheet-metal plate bent to a U-shape, the bend 5 being located in the lower part of the crossbar shown in FIG. 11 and its free ends (corresponding to the free ends of the legs 24, 24') being located in the upper part of the crossbar. In the uppermost portion of the crossbars, recesses 22 are provided which have the same shape as the recesses of the brackets 3 mentioned above. Moreover, the crossbars have the same function as that describe above in connection with said brackets 3.

A number of embodiments of the inventive fastener have been described above, and it will be obvious to the skilled person that the different features presented in the individual figures can be combined in various ways within the scope of the inventive idea.

Accordingly, the invention is not limited to that described above or shown in the drawings, and can be modified within the scope of the appended claims.

The invention claimed is:

1. A system for detachable suspension of shelves from a wall or as a freestanding arrangement, comprising:

at least two essentially vertically positioned carrier elements;

elongate, U-shaped supporting elements which support said shelves and which are fixed in a protruding manner to the carrier elements; and fasteners, which are arranged on an underside of each shelf, adjacent two opposite side edges of the shelf, and which engage an uppermost portion of the respective supporting elements, each fastener comprising a first portion, which is attached at right angles to the underside of the shelf, a second portion, which is perpendicular to the first portion and which is to abut against the underside of the shelf, and a third portion, which is essentially parallel to said first portion and inserted into an interior of the U-shaped supporting element, wherein the fastener is arranged in two opposite positions on the underside of the shelf, and wherein the second portion of the fastener has such a length that, in the first position of the fastener, said second portion is oriented toward said side edge of the shelf, thus allowing two shelves to be arranged with their side edges next to one another and to be supported by the same supporting element, and that, in the second position of the fastener, said second portion is oriented away from the side edge of the shelf, the side edge of the shelf protruding from the supporting element when the shelf is arranged thereon.

2. A system as claimed in claim 1, wherein an angle between the second and the third portions of the fastener is in a range of 84°-89°, the third portion of the fastener, in said first position, applying a pressure from an inside on a first leg of the U-shaped supporting element by a second shelf on which the fastener is positioned correspondingly being arranged on the same supporting element with the respective side edges of the shelves applying a pressure on one another and, in said second position, applying a pressure from an inside on a second leg of the U-shaped supporting element by the side edge of the shelf located opposite said side edge being fixed in an adjacent supporting element.

3. A system as claimed in claim 1, wherein the first, second and third portion of the fastener are pivotally connected to one another.

4. A system as claimed in claim 1, wherein the second and third portion of the fastener are made in one piece.

5. A system as claimed in claim 1, wherein the first, second and third portion of the fastener are made in one piece.

6. A system as claimed claim 1, wherein each fastener is formed as a separate unit.

7. A system as claimed in claim 1, wherein at the respective side edges of the shelf, the fasteners are connected to one another.

8. A system as claimed in claim 7, wherein at the respective side edges of the shelf, the fasteners are formed as a construction in one piece.

9. A system as claimed in claim 8, wherein at the respective side edges of the shelf, the fasteners are made from a bent, elongate section or wire, which comprises an intermediate element that connects two fasteners to one another.

10. A system as claimed in claim 8, wherein the second and third portion of the fasteners, at the respective side edges of the shelf, are formed of an L-shaped section, which connects the first portions of the fasteners to one another.

11. A system as claimed in claim 1, wherein each supporting element, in an uppermost portion thereof, when mounted, comprises recesses for receiving the second portion of each fastener, dimensions of the recesses corresponding to cross-sectional dimensions of said second portion, so that, when mounted, an underside of the shelf rests on the uppermost portion of the respective brackets.

12. A system as claimed in claim 2, wherein the second and third portion of the fastener are made in one piece.

13. A system as claimed in claim 2, wherein the first, second and third portion of the fastener are made in one piece.

14. A system as claimed in claim 2, wherein each fastener is formed as a separate unit.

15. A system as claimed in claim 3, wherein each fastener is formed as a separate unit.

16. A system as claimed in claim 4, wherein each fastener is formed as a separate unit.

17. A system as claimed in claim 2, wherein at the respective side edges of the shelf, the fasteners are connected to one another.

18. A system as claimed in claim 3, wherein at the respective side edges of the shelf, the fasteners are connected to one another.

19. A system as claimed in claim 2, wherein each supporting element, in an uppermost portion thereof, when mounted, comprises recesses for receiving the second portion of each fastener, dimensions of the recesses corresponding to cross-sectional dimensions of said second portion, so that, when mounted, an underside of the shelf rests on the uppermost portion of the respective brackets.

20. A system as claimed in claim 3, wherein each supporting element, in an uppermost portion thereof, when mounted, comprises recesses for receiving the second portion of each fastener, dimensions of the recesses corresponding to cross-sectional dimensions of said second portion, so that, when mounted, an underside of the shelf rests on the uppermost portion of the respective brackets.

* * * * *